US005231731A

United States Patent [19]

Jones, Jr.

[11] Patent Number: 5,231,731

[45] Date of Patent: Aug. 3, 1993

[54] LEVER ACTION RETROFIT DOOR HANDLE

[76] Inventor: Robert L. Jones, Jr., 3229 Mockingbird La., Hoover, Ala. 35226

[21] Appl. No.: 920,680

[22] Filed: Jul. 28, 1992

[51] Int. Cl.[5] ..... B25G 3/28; E05C 19/18

[52] U.S. Cl. ..... 16/114 R; 16/121; 16/DIG. 30; 292/347; 292/DIG. 2

[58] Field of Search ..... 292/336.3, 347, 350, 292/DIG. 2; 16/114.12, 121, DIG. 30

[56] References Cited

U.S. PATENT DOCUMENTS

| | | | |
|---|---|---|---|
| 3,575,453 | 4/1971 | Hohl | 292/347 |
| 3,827,739 | 8/1974 | Overholser | 292/347 |
| 3,960,396 | 6/1976 | Miyahara | 292/DIG. 2 |
| 4,285,536 | 8/1981 | McCoy et al. | 292/336.3 |
| 4,397,489 | 8/1983 | Lind | 292/347 |
| 4,504,087 | 3/1985 | Pennington | 292/347 |
| 4,783,883 | 11/1988 | Szalsy | 16/114 R |
| 4,913,479 | 4/1990 | Allison | 292/347 |
| 4,971,375 | 11/1990 | Grecco | 292/347 |

*Primary Examiner*—W. Donald Bray
*Attorney, Agent, or Firm*—Wm. Randall May

[57] ABSTRACT

A counterbalanced, one-piece, non-slip, lever action handle for retrofit adaption to existing door knobs is disclosed wherein a conforming, contoured lever handle is provided with self-tapping anchor screws for permanent attachment of the lever handle to a target door knob. Once attached, the lever handle becomes an extension of the existing door knob thereby facilitating greater access to individuals with disabilities.

12 Claims, 3 Drawing Sheets

LEVER ACTION RETROFIT DOOR HANDLE

BACKGROUND OF THE INVENTION

I. Field of the Invention

This invention relates generally to door handles and specifically to lever action retrofit handles which can be mounted to existing door knobs for greater accommodation to disabled or handicapped individuals.

II. Prior Art and Other Considerations

More and more governmental and private sector emphasis is being placed on providing equal access accommodations in public and commercial facilities to individuals with disabilities. As a result, modification of access facilities including door entry devices and hardware has become increasingly important.

A number of retrofitable door handles or levers have been provided in prior art such as those disclosed in United States Patents to Overholser, Lind, Pennington and Grecco, U.S. Pat. Nos. 3,827,739; 4,397,489; 4,507,087 and 4,971,375, respectively. However, these prior art devices are generally designed for compression or friction-fit attachment in order to secure and to operate the devices. One problem with the prior art devices has been slippage of the handle after repeated use thereby requiring periodic readjustment and retightening of the device. Another problem with the prior art devices has been the moment force produced by the lever extension of such devices which tends to overpower the door knob spring thereby requiring replacement of the spring with a stronger spring in order for the device to be effective and useful. Still another problem with the prior art devices has been the permanency of the attachment to the target door knob.

Cost and appearance are also very important factors to consider in providing suitable retrofit hardware to accomplish the modification objectives of equal access accommodation.

SUMMARY OF THE INVENTION

In view of the foregoing, it is an object of this invention to provide apparatus for a counterbalanced, one-piece, non-slip, lever action, retrofit door handle which can be quickly and permanently attached to virtually any door knob.

An advantage of the present invention is the provision of a lever action retrofit door handle which can be permanently attached to existing door knobs without the use of clamps, nuts, shims, gaskets or rings.

An advantage of the present invention is the non-slip feature of the device which is accomplished without compressing or frictionally engaging the exterior surface of the target door knob.

Another advantage of the present invention is the counterbalanced construction of the device which eliminates or greatly reduces the moment force exerted on the target door knob spring by the lever portion of the device thereby allowing for normal horizontal positioning and operation of the handle.

Another advantage of the present invention is the one-piece construction of the device which can be custom drilled to accommodate the specifications of a wide variety of door knobs.

A further advantage of the present invention is the provision of apparatus which is economical to construct and install, simple to use, and which is aesthetically pleasing to the eye.

According to an embodiment of the invention, a counterbalanced, non-slip, lever action, retrofit door handle comprises a conforming, contoured lever means and permanent mounting means. The lever means is positioned over a target door knob and is permanently and effectively secured thereto by the mounting means.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
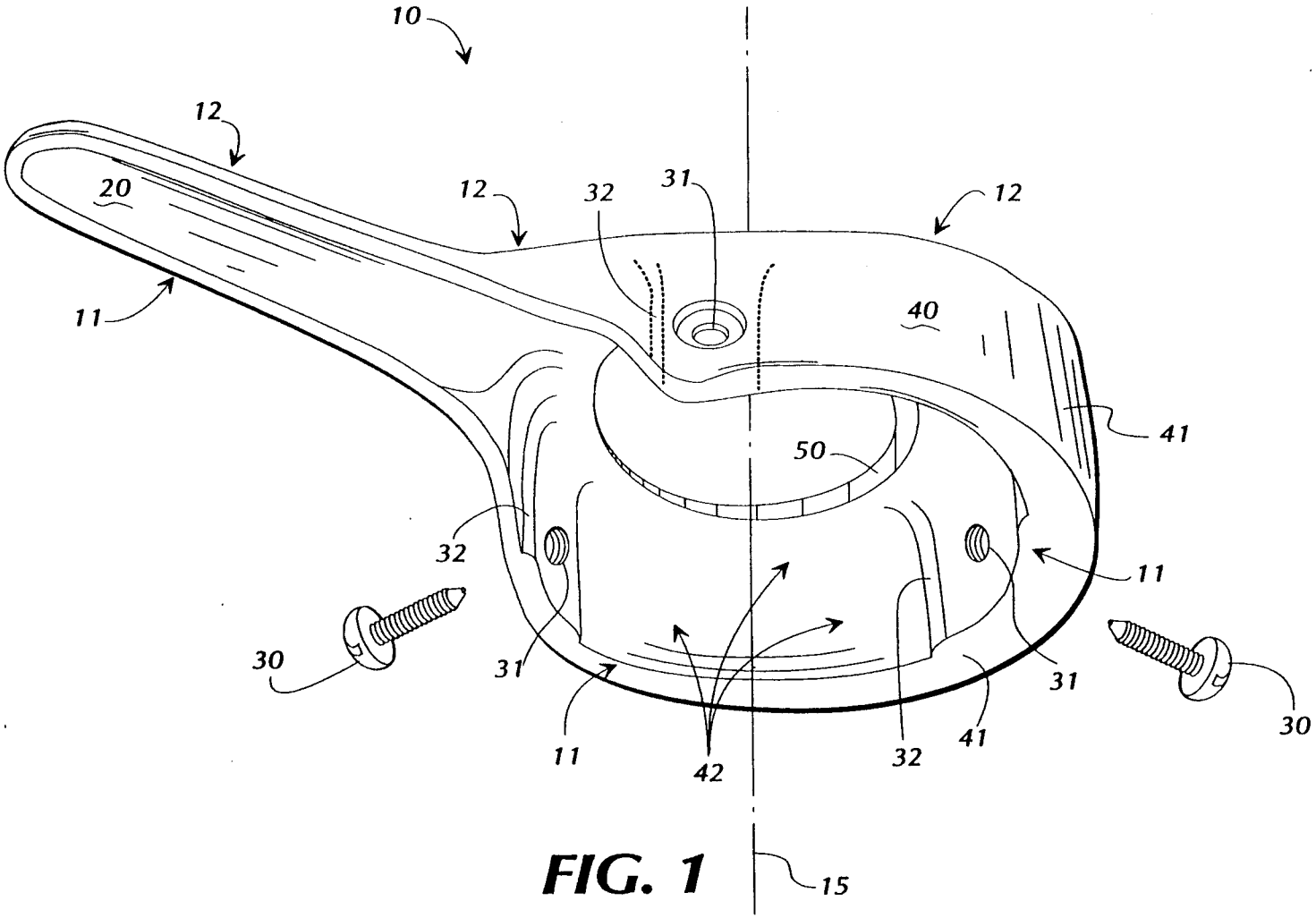
FIG. 1 is a perspective view of an embodiment of the invention.
Figure 2:
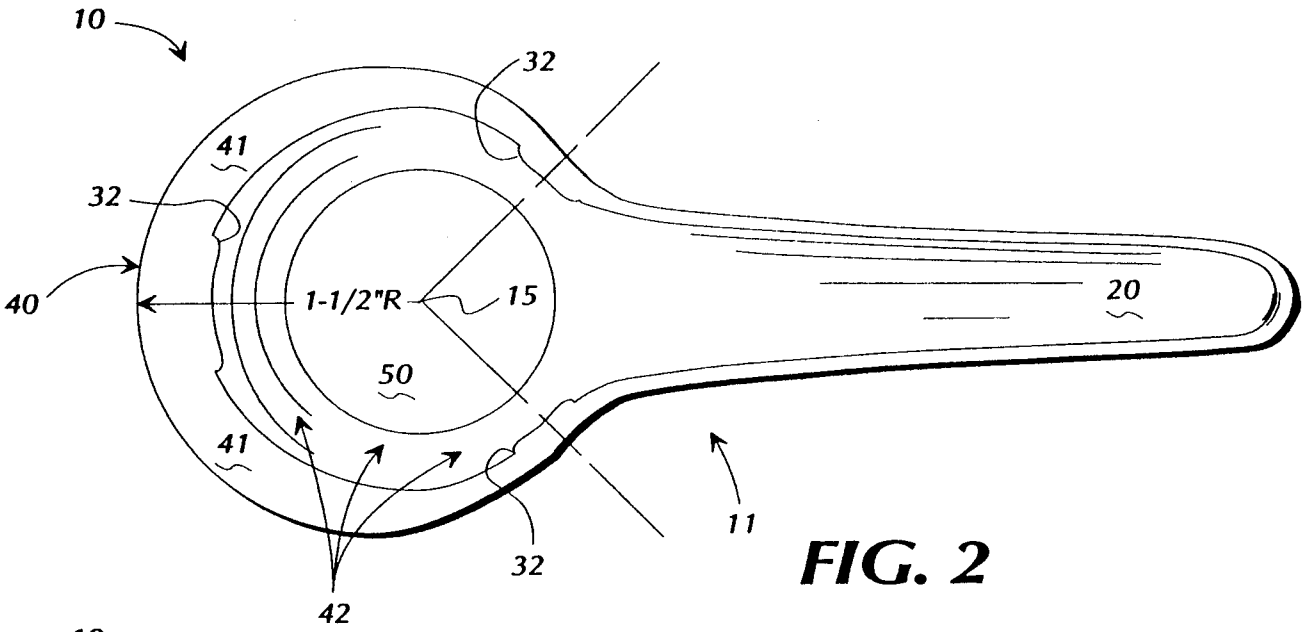
FIG. 2 is a bottom plan view of the embodiment of FIG. 1.
Figure 3:
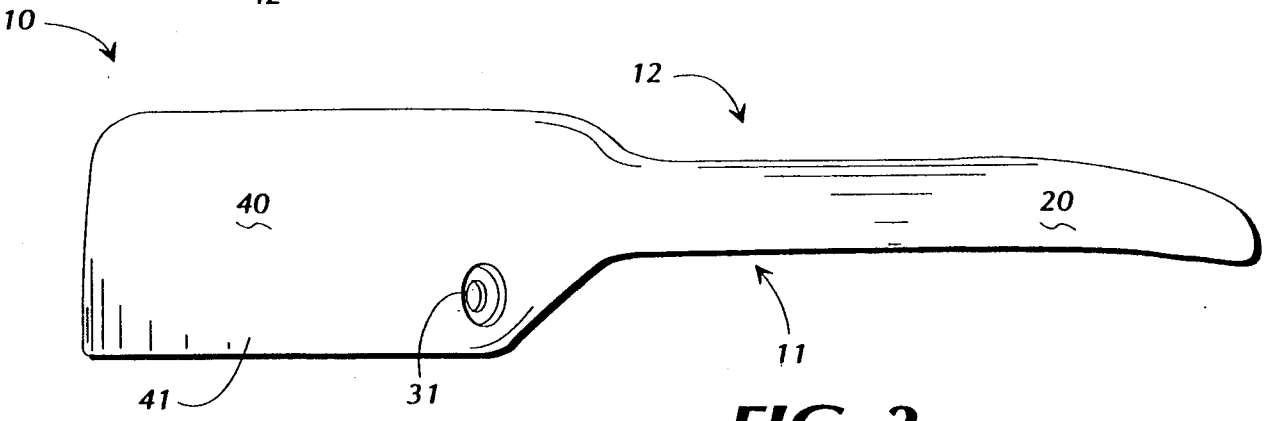
FIG. 3 is a side view of the embodiment of FIG. 1.

The counterbalanced retrofit door handle 10 of FIG. 1 is of singular construction with a "face" side 12 and a "door" side 11 and comprises a lever portion 20 and a knob attachment portion 40. The lever portion 20 and knob attachment portion 40 are homogeneous extensions of each other which together form a rigid concave-shaped shell or cavity.

Figure 4:
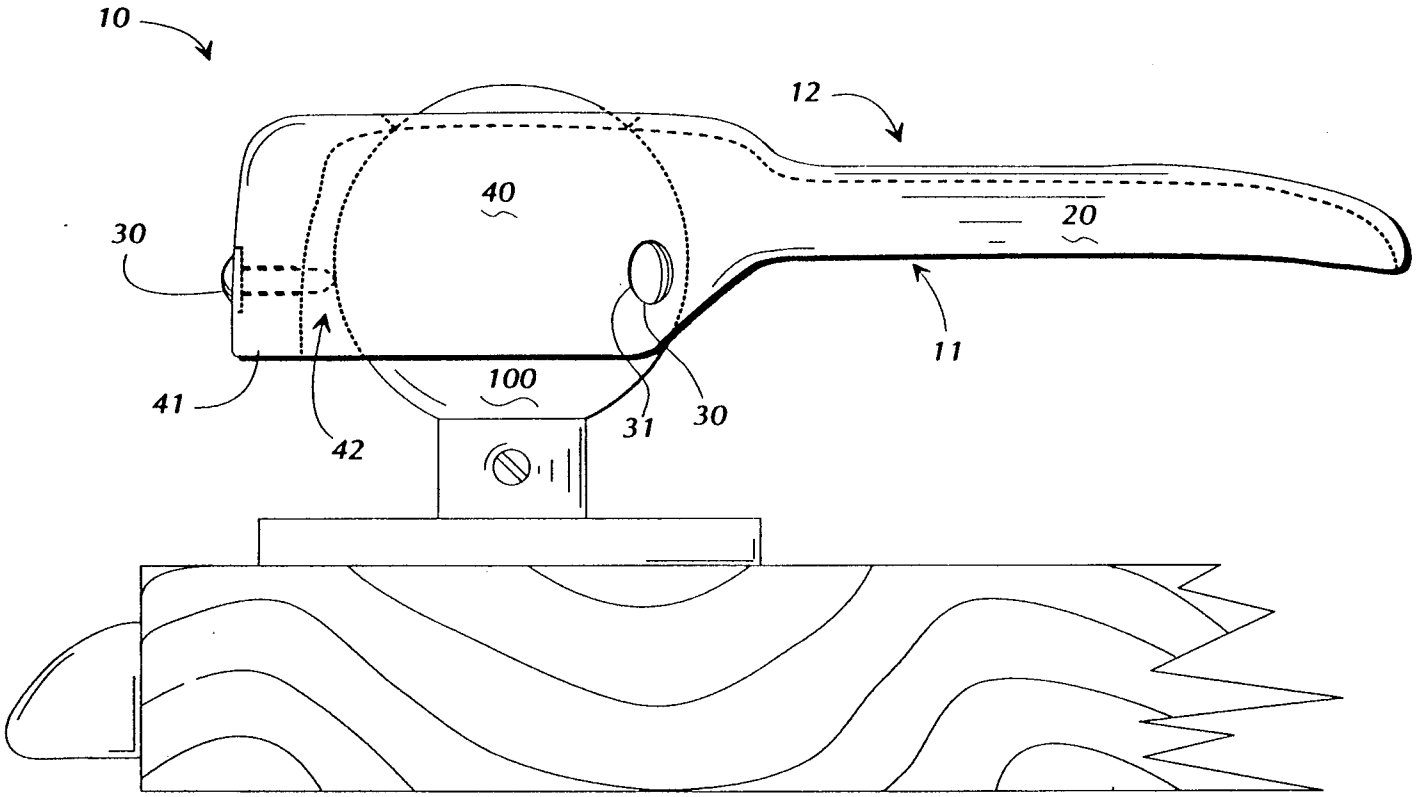
FIG. 4 is a side view of the embodiment of FIG. 1 shown operatively attached to a target door knob.

The knob attachment portion 40 defines a substantially cup-shaped basin area 42 of sufficient depth and diameter for receiving a door knob 100, as shown in FIG. 4. A lockface opening 50 is axially centered on the face side 12 of said knob attachment portion 40 and provides access to knob centered locking mechanisms and keyholes. In order to counterbalance the weight of the lever portion 20 about the mounting axis 15 of said handle 10, additional cast material is added to the cylinder wall 41 of said knob attachment portion 40 thereby thickening the portion of said wall 41 necessary to produce the desired counterbalancing effect. The knob attachment portion 40 is provided with anchor holes 31 which are axially and equidistantly spaced about the cylinder wall 41 of said knob attachment portion 40. Said anchor holes 31 are pre-drilled and countersunk to receive anchor screws 30 for securing said knob attachment portion 40 to a target door knob 100 as shown in FIG. 4. Anchor hole station platforms 32 are provided at each anchor hole 31 location and are positioned on the door side 11 of knob attachment portion 40. Said platforms 32 provide added strength and support for said anchor screws 30 and are integral to the construction of said knob attachment portion 40. The placement of said platforms 32 also assist in counterbalancing the weight of the lever portion 20 with respect to the mounting axis 15 of handle 10.

The lever portion 20 of said handle 10 is elongated and defines a substantially concave extension of the knob attachment portion 40. Said lever portion 20 is symmetrically contoured toward its end and may be curved slightly toward the door side 11 of handle 10.

The installation of handle 10 is accomplished with the use of a master handle (not shown) which is identical to said handle 10 but having threaded hollow set screws at its anchor hole 31 positions. Said set screws are used to center the master handle onto a target door knob. Once the master handle is centered, a hand drill is used to drill through the hollow set screw at each anchor hole 31 location in order to make properly aligned entry holes into the target door knob for later insertion of anchor screws 30. The anchor screws 30 for this embodiment are self-tapping and vary in size, length and type depending on the thickness and configuration of the target door knob. After the alignment holes are drilled into the target door knob, the knob attachment portion 40 of handle 10 is properly positioned onto said target knob and the anchor screws 30 are tightened down.

Where necessary or allowable, an alternate method of installing handle 10 can be utilized whereby anchor screws 30 are self-drilling and self-tapping type screws thereby eliminating the need for hand-drilled entry holes in the target door knob.

The present preferred material for construction of said handle 10 is cast aluminum alloy, however, other rigid materials of similar strength and quality could also be used.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A counterbalanced, lever action, retrofit door handle comprising:

a lever portion;

a knob attachment portion having a substantially cylindrical wall which forms a cup-shaped basin area, said basin area having one or more holes located around the perimeter of said cylindrical wall for receiving an equal number of mounting means;

means for permanently mounting the knob attachment portion of the handle to an existing door and, means for counterbalancing the weight of said lever portion with respect to said knob attachment portion and the mounting axis thereof.

2. The apparatus of claim 1, wherein said lever portion and said knob attachment portion are of singular construction and are homogeneous extensions of each other thereby forming a rigid, concave-shaped shell or cavity.

3. The apparatus of claim 1, wherein said knob attachment portion has an axially centered lockface opening at essentially the bottom of said cup-shaped basin area for providing access to knob centered locking mechanisms or keyholes.

4. The apparatus of claim 1, wherein said lever portion comprises an elongated concave extension of said knob attachment portion.

5. The apparatus of claim 1, wherein said anchor holes of said knob attachment portion are countersunk and are axially and equidistantly spaced about the perimeter wall of said cup-shaped basin area.

6. The apparatus of claim 1, wherein said means for counterbalancing said handle comprises the addition of cast material to the cylindrical wall of the knob attachment portion, thereby increasing the thickness and weight of at least a portion of said wall.

7. The apparatus of claim 1, wherein said cylindrical wall of said knob attachment portion further comprises mounting hole station platforms at each mounting hole location for support of said mounting hole and said mounting means.

8. The apparatus of claim 7, wherein said platforms are homogeneous and integral to the construction of said knob attachment portion.

9. The apparatus of claim 7, wherein one or more of said platforms are placed about the perimeter of said cylindrical wall at locations which assist in counterbalancing the weight of the lever portion of the handle.

10. The apparatus of claim 1, wherein said means for permanently mounting the knob attachment portion of the handle to an existing door knob comprises one or more anchor screws.

11. The apparatus of claim 10, wherein said anchor screws are self-tapping.

12. The apparatus of claim 10, wherein said anchor screws are self-drilling and self-tapping.

* * * * *